US010997938B2

(12) United States Patent
Kim et al.

(10) Patent No.: US 10,997,938 B2
(45) Date of Patent: May 4, 2021

(54) DISPLAY PANEL DRIVING APPARATUS HAVING AN OFF VOLTAGE CONTROLLED BASED ON A LEAKAGE CURRENT, METHOD OF DRIVING DISPLAY PANEL USING THE SAME, AND DISPLAY APPARATUS HAVING THE SAME

(71) Applicant: SAMSUNG DISPLAY CO., LTD., Yongin-si (KR)

(72) Inventors: Hong-Kyu Kim, Suwon-si (KR); Po-Yun Park, Seoul (KR); Gwang-Soo Ahn, Suwon-si (KR); Jung-Hwan Cho, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/196,608

(22) Filed: Nov. 20, 2018

(65) Prior Publication Data

US 2019/0108812 A1 Apr. 11, 2019

Related U.S. Application Data

(62) Division of application No. 15/002,039, filed on Jan. 20, 2016, now Pat. No. 10,163,417.

(30) Foreign Application Priority Data

Jul. 10, 2015 (KR) ..... 10-2015-0098553

(51) Int. Cl.
*G09G 3/36* (2006.01)
*G09G 3/00* (2006.01)

(52) U.S. Cl.
CPC ..... *G09G 3/3688* (2013.01); *G09G 3/3677* (2013.01); *G09G 3/003* (2013.01);
(Continued)

(58) Field of Classification Search
None
See application file for complete search history.

(56) References Cited

U.S. PATENT DOCUMENTS

2007/0052646 A1 3/2007 Ishiguchi
2008/0079701 A1* 4/2008 Shin ..... G11C 19/184 345/204

(Continued)

FOREIGN PATENT DOCUMENTS

JP 2011-075999 4/2011
KR 1020070109165 11/2007

(Continued)

*Primary Examiner* — Amr A Awad
*Assistant Examiner* — Donna V Lui
(74) *Attorney, Agent, or Firm* — F. Chau & Associates, LLC

(57) ABSTRACT

A display panel driving apparatus includes a data driving part, a data driving part and an off voltage controlling part. The data driving part is configured to output a data signal to a data line of a display panel. The gate driving part is configured to output a gate signal to a gate line of the display panel. The off voltage controlling part is configured to receive a first off voltage and a second off voltage applied to the gate driving part to generate the gate signal, measure a leakage current of the gate driving part, and control the first off voltage based on the leakage current. Thus, display quality of a display apparatus including the gate driving part may be improved.

11 Claims, 13 Drawing Sheets

(52) U.S. Cl.
CPC ..... *G09G 3/3696* (2013.01); *G09G 2310/06* (2013.01); *G09G 2310/08* (2013.01); *G09G 2320/0295* (2013.01); *G09G 2330/021* (2013.01); *G09G 2330/027* (2013.01)

(56) References Cited

U.S. PATENT DOCUMENTS

| | | | | |
|---|---|---|---|---|
| 2010/0309183 | A1 | 12/2010 | Mizusako | |
| 2012/0146985 | A1* | 6/2012 | Lee ..... | G09G 3/3614 345/212 |
| 2013/0328846 | A1 | 12/2013 | Jamal et al. | |
| 2014/0085172 | A1 | 3/2014 | Wu et al. | |
| 2014/0168186 | A1 | 6/2014 | Kang et al. | |
| 2014/0313113 | A1 | 10/2014 | Jang et al. | |
| 2014/0354619 | A1 | 12/2014 | Jang et al. | |
| 2017/0011700 | A1 | 1/2017 | Kim et al. | |

FOREIGN PATENT DOCUMENTS

| | | |
|---|---|---|
| KR | 1020080039719 | 5/2008 |
| KR | 1020100074858 | 7/2010 |

* cited by examiner

DISPLAY PANEL DRIVING APPARATUS HAVING AN OFF VOLTAGE CONTROLLED BASED ON A LEAKAGE CURRENT, METHOD OF DRIVING DISPLAY PANEL USING THE SAME, AND DISPLAY APPARATUS HAVING THE SAME

PRIORITY STATEMENT

This application is a divisional of U.S. application Ser. No. 15/002,039, filed on Jan. 20, 2016, which claims priority under 35 U.S.C. § 119 to Korean Patent Application No. 10-2015-0098553, filed on Jul. 10, 2015 in the Korean Intellectual Property Office (KIPO), the contents of which are herein incorporated by reference in their entireties.

TECHNICAL FIELD

Exemplary embodiments of the present inventive concept relate to a display panel driving apparatus, a method of driving a display panel using the display panel driving apparatus, and a display apparatus having the display panel driving apparatus.

DESCRIPTION OF RELATED ART

A display apparatus such as a liquid crystal display apparatus includes a display panel and a display panel driving apparatus.

The display panel includes a gate line, a data line and a pixel.

The display panel driving apparatus includes a gate driving part driving the gate line, a data driving part driving the data line, and a timing controlling part controlling a timing of the gate driving part and the data driving part.

The gate driving part outputs a gate signal to the gate line to drive the gate line. The gate driving part receives an on voltage and an off voltage from a voltage managing part such as a Power Management Integrated Circuit (PMIC), and generates the gate signal using the on voltage and the off voltage.

However, the off voltage and a leakage current of the gate driving part are changed to reduce an operation time of the gate driving part.

SUMMARY

Exemplary embodiments of the present inventive concept also provide a method of driving a display panel using the above-mentioned display panel driving apparatus.

Exemplary embodiments of the present inventive concept also provide a display apparatus having the above-mentioned display panel driving apparatus.

According to an exemplary embodiment of the present inventive concept, a display panel driving apparatus includes a data driving part, a data driving part and an off voltage controlling part. The data driving part is configured to output a data signal to a data line of a display panel. The gate driving part is configured to output a gate signal to a gate line of the display panel. The off voltage controller receives a first off voltage and a second off voltage applied to the gate driving part to generate the gate signal, a leakage current measuring part measures a leakage current of the gate driving part, and the off voltage controller controls the first off voltage based on the leakage current.

In an exemplary embodiment, the off voltage controller may include a leakage current measuring part configured to measure the leakage current and output a current signal.

In an exemplary embodiment, the leakage current measurer may include a thin film transistor including a gate electrode to Which the first off voltage is applied, a drain electrode to which the second off voltage is applied and a source electrode through which the current signal is output.

In an exemplary embodiment, the off voltage controller may further include a current detecting part configured to receive the current signal, detect the current signal and output a current level signal indicating a level of the current signal.

In an exemplary embodiment, the off voltage controller may further include an analog digital converting part configured to receive the current level signal, and output a voltage level data by converting the current level signal into a digital type.

In an exemplary embodiment, the off voltage controller may further include a look-up table storing the first off voltage according to the voltage level data.

In an exemplary embodiment, the display panel driving apparatus may further include a timing controlling part configured to output a first clock signal and a horizontal start signal controlling a timing of the data driving part and output a second clock signal and a vertical start signal controlling a timing of the gate driving part, and the timing controlling part may include the look-up table, and output a voltage control signal for controlling the first off voltage, according to the voltage level data.

In an exemplary embodiment, the off voltage controller may further include a voltage manager, the voltage manager applies the first off voltage to the gate driving part and output a clock signal having an on voltage and the second off voltage, and the voltage managing part may control the first off voltage according to the voltage control signal output from the timing controlling part.

In an exemplary embodiment, the off voltage controller may further include a voltage manager, the voltage manager applies the first off voltage to the gate driving part and output a clock signal having an on voltage and the second off voltage, and the voltage manager may include the look-up table, and control the first off voltage according to the voltage level data output from the analog digital converting part.

In an exemplary embodiment, the leakage current measuring part may output a feedback voltage signal according to the leakage current, using an RC delay.

In an exemplary embodiment, the off voltage controller may further include a voltage detecting part configured to receive the feedback voltage signal, and detect the feedback voltage signal to output a voltage level signal indicating a level of the feedback voltage signal.

In an exemplary embodiment, the off voltage controller may further include an analog digital converting part configured to receive the voltage level signal and output a voltage level data by converting the voltage level signal into a digital type.

In an exemplary embodiment, the off voltage controller may further include a voltage providing part configured to apply a gate input voltage corresponding to the first off voltage and a drain input voltage corresponding to the second off voltage to a thin film transistor of the leakage current measuring part.

In an exemplary embodiment, the gate driving part may be mounted on the display panel.

In an exemplary embodiment, the gate driving part may be an Oxide Silicon Gate (OSG).

In an exemplary embodiment, the leakage current measuring part may be mounted on the display panel.

According to an exemplary embodiment of the present inventive concept, a method of driving a display panel includes applying a first off voltage and a second off voltage applied to a gate driving part to output a gate signal, to an off voltage controlling part, measuring a leakage current of the gate driving part, using the first off voltage and the second off voltage applied to the off voltage controlling part, controlling the first off voltage, based on the leakage current, outputting the gate signal to a gate line of a display panel, using a clock signal having the controlled first off voltage and a clock signal having an on voltage and the second off voltage, and outputting a data signal to a data line of the display panel.

In an exemplary embodiment, the controlling the first off voltage, based on the leakage current may include detecting a current signal corresponding to the leakage current and output from the leakage current measuring part to which the first off voltage and the second off voltage are applied, to output a current level signal indicating a level of the current signal, outputting a voltage level data by converting the current level signal into a digital type, and controlling the first off voltage according to the voltage level data.

In an exemplary embodiment, the controlling the first off voltage, based on the leakage current may include detecting a feedback voltage according to the leakage current and output from the leakage current measuring part to which the first off voltage and the second off voltage are applied, to output a voltage level signal indicating a level of the feedback voltage, outputting a voltage level data by converting the voltage level signal into a digital type, and controlling the first off voltage according to the voltage level data.

According to an exemplary embodiment of the present inventive concept, a display apparatus includes a display panel and a display panel driving apparatus. The display panel includes a gate line and a data line. The display panel driving apparatus includes a data driving part configured to output a data signal to the data line of the display panel, a gate driving part configured to output a gate signal to the gate line of the display panel, and an off voltage controlling part configured to receive a first off voltage and a second off voltage applied to the gate driving part to generate the gate signal, measure a leakage current of the gate driving part, and control the first off voltage based on the leakage current.

According to the present inventive concept, since an off voltage applied to a gate driving part is controlled based on a leakage current of the gate driving part, an increase of the leakage current of the gate driving part may be prevented. Therefore, an operation error of the gate driving part may be prevented, and thus display quality of a display apparatus including the gate driving part may be improved.

According to an exemplary embodiment of the present inventive concept, a display apparatus includes a voltage manager generates a vertical start voltage, a first clock signal and a first off voltage based on a vertical start signal, a second clock signal and a voltages level data. The display apparatus also includes voltage providing part to generate the first off voltage and a second off voltage. The display apparatus also includes a display panel, which may include a leakage current measuring part, to display an image based on the vertical start signal, the first clock signal, the first off voltage and a data signal. The leakage current measuring part measures a leakage current and outputs a current signal based on the first off voltage and the second off voltage.

In an exemplary embodiment, the display apparatus includes a current detecting part generates a current level signal based on the current signal, and an analog digital converting part generates a voltage level data based on the current level signal.

In an exemplary embodiment, the display apparatus includes a timing controller to generate image data, a horizontal start signal and a third clock signal. The display apparatus may include the control signal includes a horizontal synchronous signal, a vertical synchronous signal and fourth clock signal, the image data is based on the image data received from an outside source, the horizontal start signal is based on the horizontal synchronous signal and the third clock signal is based on a clock signal received from an outside source.

In an exemplary embodiment, the display apparatus includes a data driving part to generate data signal based on the image data, horizontal start signal and the third clock signal.

In an exemplary embodiment, the display apparatus includes the timing controller includes a look-up table storing the first off voltage according to the voltage level data.

BRIEF DESCRIPTION OF THE DRAWINGS

The above and other features of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
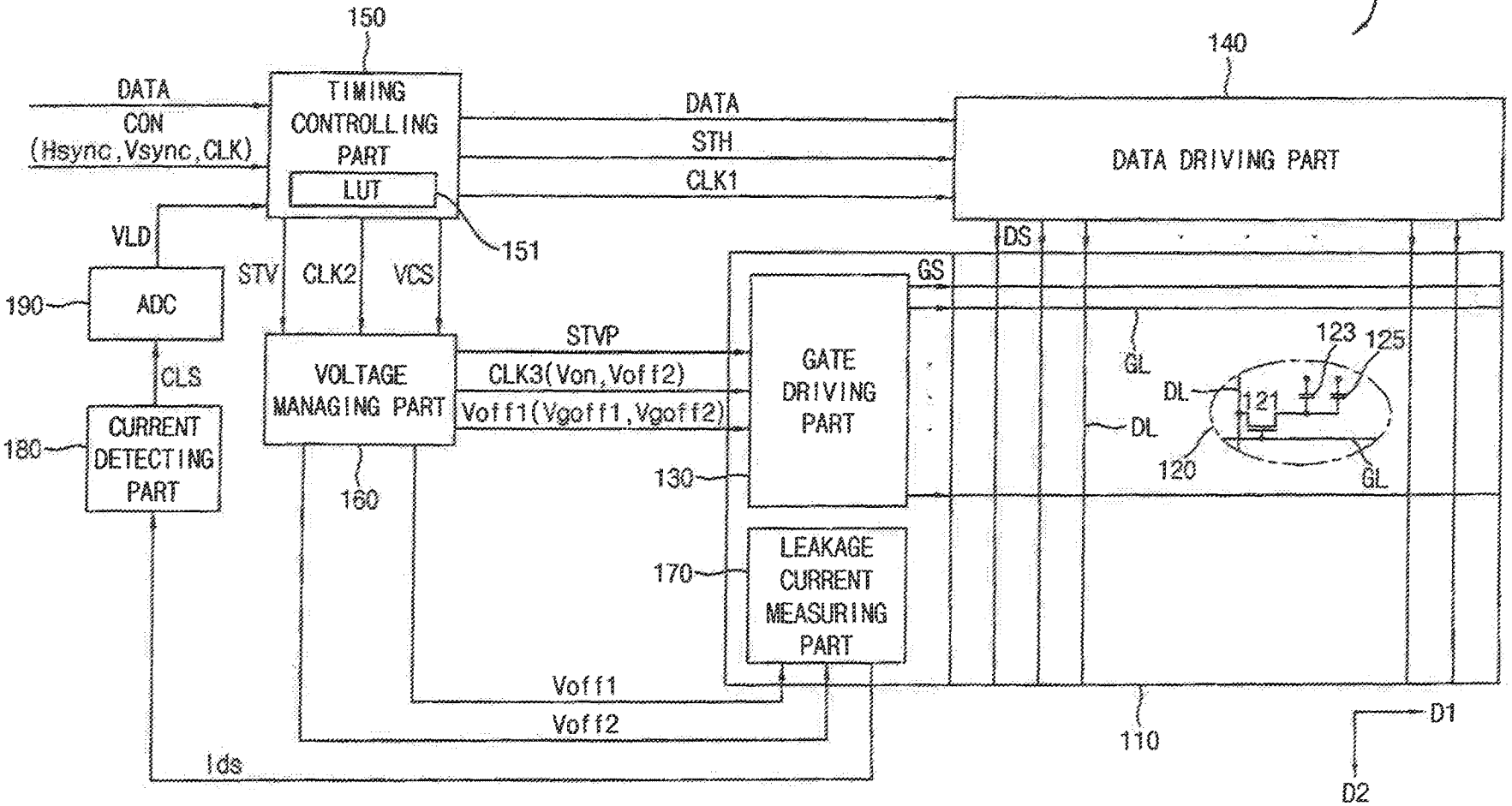
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130, a data driving part 140, a timing controlling part 150, a voltage managing part 160, a leakage current measuring part 170, a current detecting part 180 and an analog digital converting part 190. The voltage managing part 160 may be referred to as a voltage manager.

The display panel 110 receives a data signal DS based on an image data DATA provided from the timing controlling part 150 to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel.

The data driving part 140 outputs the data signals DS to the data line DL in response to a horizontal start signal STH and a first clock signal CLK1 provided from the timing controlling part 150.

The gate driving part 130 generates a gate signal GS using a vertical start voltage STVP output from the voltage managing part 160, based on a vertical start signal STV output from the timing controlling part 150, a third clock signal CLK3 output from the voltage managing part 160, based on the second clock signal CLK2 output from the timing controlling part 150, and a first off voltage Voff1 applied from the voltage managing part 160, and outputs the gate signal GS to the gate line GL. The vertical start voltage STVP may be an amplified signal of the vertical start signal STV. In addition, the third clock signal CLK3 may be an amplified signal of the second clock signal CLK2. For example, the gate driving part 130 may be an Oxide Silicon Gate (OSG). Thus, the gate driving part 130 may be mounted on the display panel 110.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 outputs the image data DATA to the data driving part 140. In addition, the timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the voltage managing part 160. In addition, the timing controlling part 150 generates the first clock signal CLK1 and the second clock signal CLK2 using the clock signal CLK, outputs the first clock signal CLK1 to the data driving part 140, and outputs the second clock signal CLK2 to the voltage managing part 160.

The voltage managing part 160 amplifies the vertical start signal STV output from the timing controlling part 150 to generate the vertical start voltage STVP, and outputs the vertical start voltage STVP to the gate driving part 130. In addition, the voltage managing part 160 amplifies the second clock signal CLK2 output from the timing controlling part 150 to generate the third clock signal CLK3, and outputs the third clock signal CLK3 to the gate driving part 130. In addition, the voltage managing part 160 applies the first off voltage Voff1 to the gate driving part 130.

Figure 2:
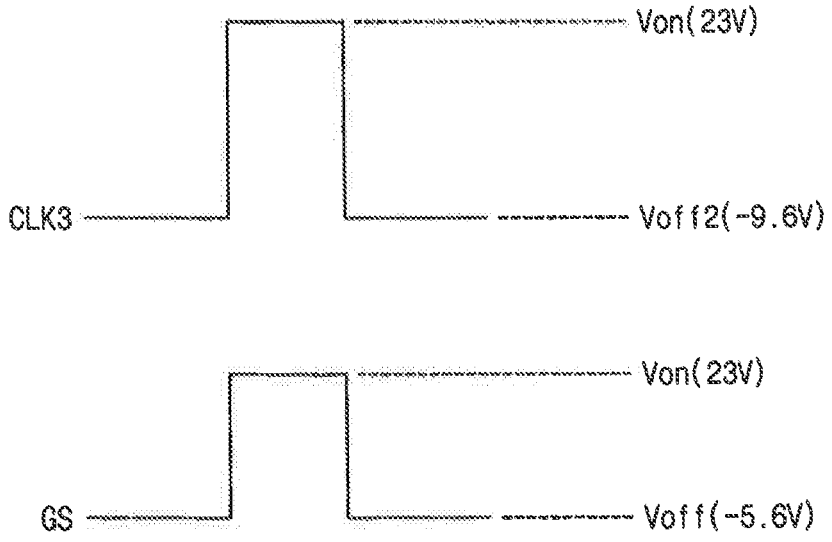
FIG. 2 is a waveforms diagram illustrating a third clock signal and a gate signal of FIG. 1.

FIG. 2 is a waveforms diagram illustrating the third clock signal CLK3 and the gate signal GS of FIG. 1.

Referring to FIGS. 1 and 2, the third clock signal CLK3 may have an on voltage Von and the second off voltage Voff2. For example, the on voltage Von may be about 23 volts, and the second off voltage Voff2 may be about −9.6 volts.

The gate signal GS may have the on voltage Von and the first off voltage Voff1. For example, the on voltage Von may be about 23 volts, and the second off voltage Voff2 may be about −5.6 volts.

Referring to FIG. 1 again, the voltage managing part 160 applies the first off voltage Voff1 and the second off voltage Voff2 to the leakage current measuring part 170.

The leakage current measuring part 170 measures a leakage current of the gate driving part 130 when the first off voltage Voff1 and the second off voltage Voff2 are applied to the gate driving part 130. The leakage current measuring part 170 receives the first off voltage Voff1 and the second off voltage Voff2 from the voltage managing part 160, and measures the leakage current of the gate driving part 130, using the first off voltage Voff1 and the second off voltage Voff2. The leakage current measuring part 170 outputs a current signal Ids corresponding to the leakage current by measuring the leakage current. For example, the leakage current measuring part 170 may output the current signal Ids through a common voltage feedback line. The leakage current measuring part 170 may be mounted on the display panel 110.

Figure 3:
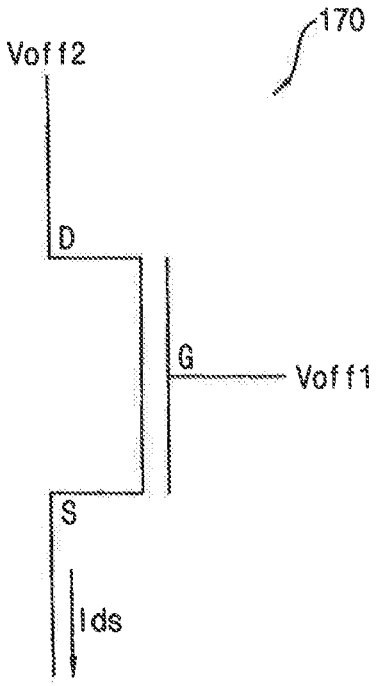
FIG. 3 is a circuit diagram illustrating a leakage current measuring part FIG. 1.

FIG. 3 is a circuit diagram illustrating the leakage current measuring part 170 FIG. 1.

Referring to FIGS. 1 and 3, the leakage current measuring part 170 may include a thin film transistor. Here, the thin film transistor may include a gate electrode U to which the first off voltage Voff1 is applied, a drain electrode D to which the second off voltage Voff2 is applied, and a source electrode S through which the current signal Ids is output.

Referring to FIG. 1 again, the current detecting part 180 receives the current signal Ids from the leakage current measuring part 170, and detects the current signal Ids to output a current level signal CLS indicating a level of the current signal Ids.

The analog digital converting part 190 receives the current level signal CLS from the current detecting part 180, and outputs voltage level data VLD generated by converting the current level signal CLS through an analog digital conversion, to the timing controlling part 150.

In this case, the timing controlling part 150 outputs a voltage control signal VCS for controlling the first off voltage Voff1 to the voltage managing part 160, according to the voltage level data VLD. The timing controlling part 150 may include a look-up table 151 storing the first off voltage Voff1 according to the voltage level data VLD.

The voltage managing part 160 receiving the voltage control signal VCS from the timing controlling part 150 controls the first off voltage Voff1 according to the voltage control signal VCS. In this case, the voltage managing part 160 may control the first off voltage Voff1 by controlling the second off voltage Voff2. For example, the first off voltage Voff1 may be greater than the second off voltage Voff2, and a difference between the first voltage Voff1 and the second voltage Voff2 may be about 4 volts.

Figure 4:
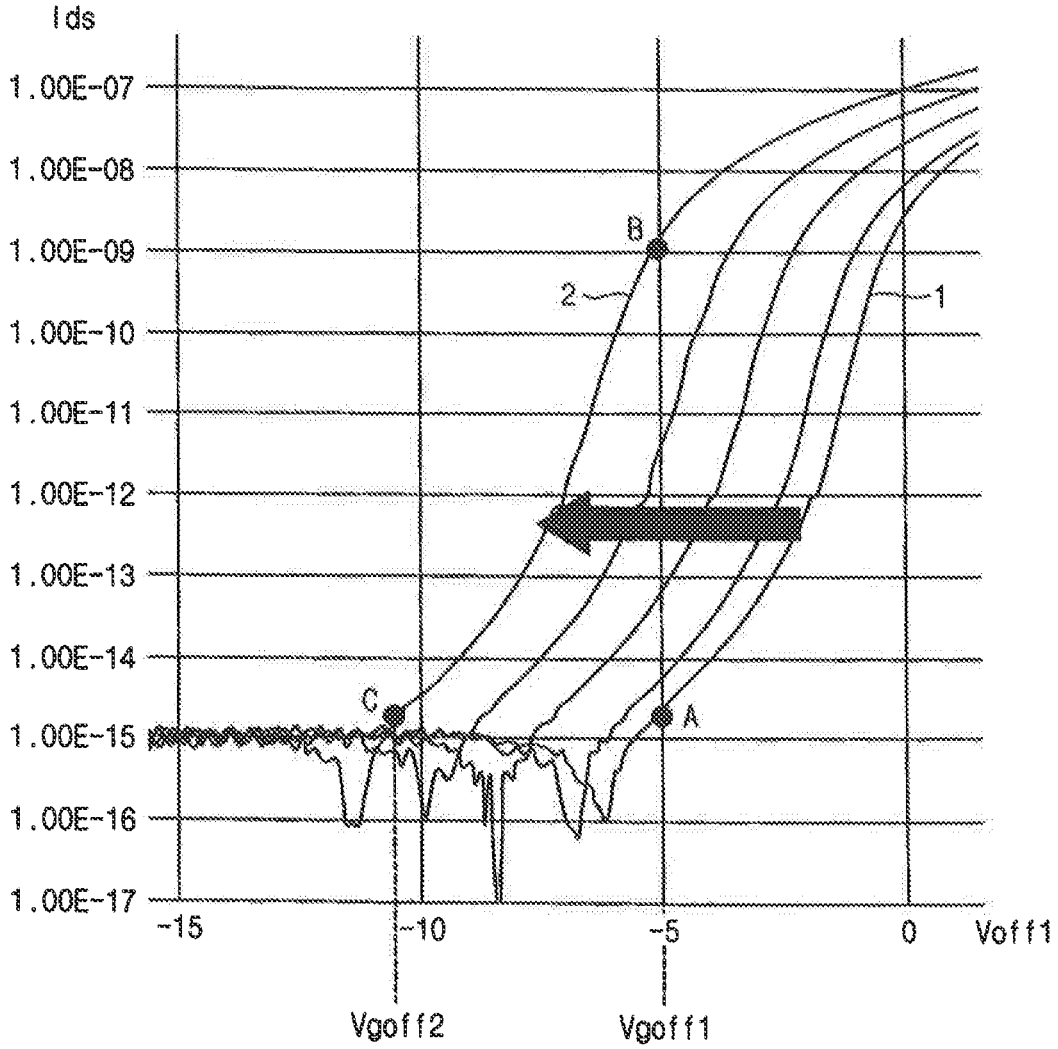
FIG. 4 is a graph illustrating a relation of a first off voltage and a current signal of FIG. 1 according to a lapse of time.

FIG. 4 is a graph illustrating the relationship of the first off voltage Voff1 and the current signal Ids of FIG. 1 according to a lapse of time.

Referring to FIGS. 1 and 4, the relationship of the first off voltage Voff1 and the current signal Ids according to the lapse of time may be changed from a first graph 1 to a second graph 2.

In a case in which the relationship of the first off voltage Voff1 and the current signal Ids is shown as the first graph 1, when the first off voltage Voff1 is a first gate off voltage Vgoff1, the current signal Ids is about 0.001 pica ampere (pA) as shown at a point A. In this case, for example, the first gate off voltage Vgoff1 may be about −5.6 volts, the current level signal CLS may be about 1 volt, the voltage level data VLD may be '00000100'.

However, in a case in which the relation of the first off voltage Voff1 and the current signal Ids is changed to the second graph 2, when the first off voltage Voff1 is the first gate off voltage Vgoff1, the current of the current signal Ids is about 1000 pA as shown at a point B. Thus, the leakage current of the gate driving part 130, which indicated by the current signal Ids increases. In this case, for example, the first gate off voltage Vgoff1 may be about −5.6 volts, the current level signal CLS may be about 5 volts, and the voltage level data VLD may be '00100000'.

In the case in which the relation of the first off voltage Voff1 and the current signal Ids is changed to the second graph 2, when the first off voltage Voff1 is a second gate off voltage Vgoff2, the current of the current signal Ids is about 0.001 pA as shown at a point C. Thus, the leakage current of the gate driving part 130, which indicated by the current signal Ids is maintained.

Therefore, in the case in which the relationship of the first off voltage Voff1 and the current signal Ids is changed from the first graph 1 to the second graph 2, the voltage managing part 160 may change the first off voltage Voff1 from the first gate off voltage Vgoff1 to the second gate off voltage Vgoff2, according to the voltage control signal VCS output based on the leakage current of the gate driving part 130. For example, the first gate off voltage Vgoff1 may be about −5.6 volts, and the second gate off voltage Vgoff2 may be about −10.6 volts.

Referring to FIG. 1 again, since the gate driving part 130, the data driving part 140, the timing controlling part 150, the voltage managing part 160, the leakage current measuring part 170, the current detecting part 180 and the analog digital converting part 190 are used for driving the display panel 110, the gate driving part 130, the data driving part 140, the timing controlling part 150, the voltage managing part 160, the leakage current measuring part 170, the current detecting part 180 and the analog digital converting part 190 may be defined as a display panel driving apparatus.

In addition, since the timing controlling part 150, the voltage managing part 160, the leakage current measuring part 170, the current detecting part 180 and the analog digital converting part 190 are used for controlling the first off voltage Voff1 and the second off voltage Voff2, the timing controlling part 150, the voltage managing part 160, the leakage current measuring part 170, the current detecting part 180 and the analog digital converting part 190 may be defined as an off voltage controlling part. The off voltage controlling part may be referred to as an off voltage controller.

Figure 5:
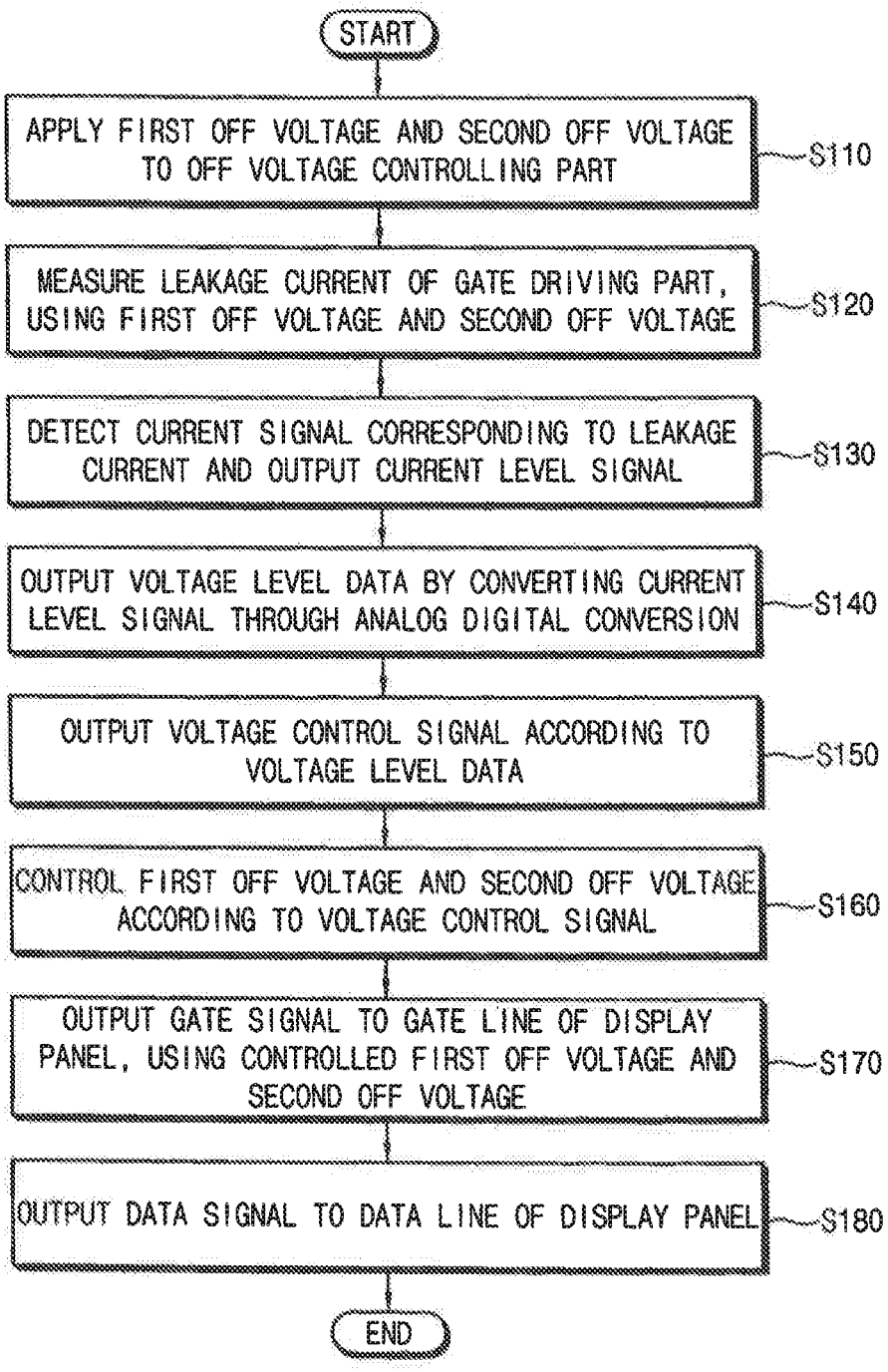
FIG. 5 is a flow chart illustrating a method of driving a display panel performed by a display panel driving apparatus of FIG. 1.

FIG. 5 is a flow chart illustrating a method of driving a display panel performed by the display panel driving apparatus of FIG. 1.

Referring to FIGS. 1 and 5, the first off voltage Voff1 and the second off voltage Voff2 are applied to the off voltage controlling part (step S110). The voltage managing part 160 applies the first off voltage Voff1 and the second off voltage Voff2 applied to the gate driving part 130 to generate the gate signal GS, to the leakage current measuring part 170.

The leakage current of the gate driving part 130 is measured using the first off voltage Voff1 and the second off voltage Voff2 (step S120). The leakage current measuring part 170 receives the first off voltage Voff1 and the second off voltage Voff2 from the voltage managing part 160, measures the leakage current of the gate driving part 130 when the first off voltage Voff1 and the second off voltage Voff2 are applied to the gate driving part 130, and outputs the current signal Ids.

The current signal Ids corresponding to the leakage current is detected and the current level signal CLS is output (step S130). The current detecting part 180 receives the current signal Ids from the leakage current measuring part 170, and detects the current signal Ids to output the current level signal CLS indicating the level of the current signal Ids.

The current level signal CLS is converted through an analog digital conversion and the voltage level data VLD is output (step S140). The analog digital converting part 190 receives the current level signal CLS from the current detecting part 180, and outputs the voltage level data VLD by converting the current level signal CLS through the analog digital conversion, to the timing controlling part 150.

The voltage control signal VCS is output according to the voltage level data VLD (step S150). The timing controlling part 150 outputs the voltage control signal VCS for controlling the first off voltage Voff1 to the voltage managing part 160, according to the voltage level data VED. The timing controlling part 150 may include the look-up table 151 storing the first off voltage Voff1 according to the voltage level data VLD.

The first off voltage Voff1 and the second off voltage Voff2 are controlled according to the voltage control signal VCS (step S160). The voltage managing part 160 controls the first off voltage Voff1 according to the voltage control signal VCS. In this case, the voltage managing part 160 may control the first off voltage Voff1 by controlling the second off voltage Voff2.

The gate signal GS is output to the gate line GL of the display panel 110, using the controlled first off voltage Voff1 and the controlled second off voltage Voff2 (step S170). The gate driving part 130 generates the gate signal GS, using the first off voltage Voff1 applied from the voltage managing part 160, the third clock signal CLK3 output from the voltage managing part 160 and including the second off voltage Voff2 and the on voltage Von, and the vertical start voltage STVP output from the voltage managing part 160, and outputs the gate signal GS to the gate line GL of the display panel 110.

The data signal DS is output to the data line DL of the display panel 110 (step S180). The data driving part 140 outputs the data signals DS to the data line DL response to the horizontal start signal STH and the first clock signal CLK1 provided from the timing controlling part 150.

According to the present exemplary embodiment, the off voltage controlling part including the timing controlling part 150, the voltage managing part 160, the leakage current measuring part 170, the current detecting part 180 and the analog digital converting part 190 controls the first off voltage Voff1 and the second off voltage Voff2 applied to the gate driving part 130, based on the leakage current of the gate driving part 130, and thus an increase of the leakage current of the gate driving part 130 may be prevented. Therefore, an operation error of the gate driving part 130 may be prevented, and thus display quality of the display apparatus 100 including the gate driving part 130 may be improved.

Figure 6:
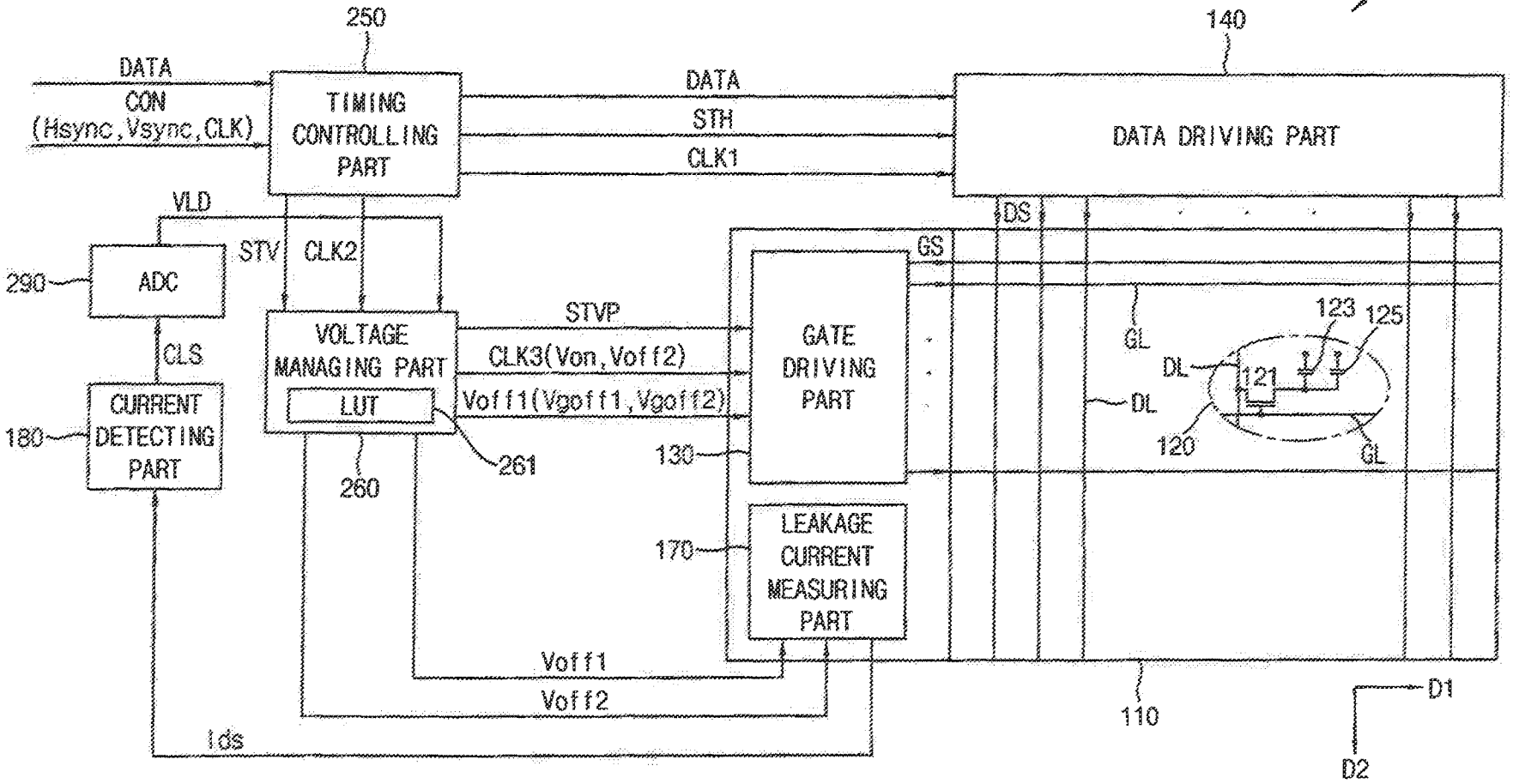
FIG. 6 is a block diagram illustrating a display apparatus according to an exemplary embodiment of the present inventive concept.

FIG. 6 is a block diagram illustrating a display apparatus according to an exemplary embodiment of the present inventive concept.

The display apparatus 200 according to the present exemplary embodiment is substantially the same as the display apparatus 100 according to the previous exemplary embodiment illustrated in FIG. 1 except for a timing controlling part 250, a voltage managing part 260 and an analog digital converting part 290. Thus, the same reference numerals will be used to refer to same or like parts as those described in the previous exemplary embodiment and any further repetitive explanation concerning the above elements will be omitted.

Referring to FIG. 6, the display apparatus 200 according to the present exemplary embodiment includes the display panel 110, the gate driving part 130, the data driving part 140, the timing controlling part 250, the voltage managing part 260, the leakage current measuring part 170, the current detecting part 180 and the analog digital converting part 290. The voltage managing part 260 may be referred to as a voltage manager.

The timing controlling part 250 receives the image data DATA and the control signal CON from an outside source. The control signal CON may include the horizontal synchronous signal Hsync, the vertical synchronous signal Vsync and the clock signal CLK. The timing controlling part 250 outputs the image data DATA to the data driving part 140. In addition, the timing controlling part 250 generates the horizontal start signal STH using the horizontal synchronous signal Hsync and outputs the horizontal start signal STH to the data driving part 140. In addition, the timing controlling part 250 generates the vertical start signal STV using the vertical synchronous signal V sync and outputs the vertical start signal STV to the voltage managing part 260. In addition, the timing controlling part 250 generates the first clock signal CLK1 and the second clock signal CLK2 using the clock signal CLK, outputs the first clock signal CLK1 to the data driving part 140, and outputs the second clock signal CLK2 to the voltage managing part 260.

The voltage managing part 260 amplifies the vertical start signal STV output from the timing controlling part 250 to generate the vertical start voltage STVP, and outputs the vertical start voltage STVP to the gate driving part 130. In addition, the voltage managing part 260 amplifies the second clock signal CLK2 output from the timing controlling part 250 to generate the third clock signal CLK3, and outputs the third clock signal CLK3 to the gate driving part 130. Additionally, the voltage managing part 260 applies the first off voltage Voff1 to the gate driving part 130. In addition, the voltage managing part 260 applies the first off voltage Voff1 and the second off voltage Voff2 to the leakage current measuring part 170.

The analog digital converting part 290 receives the current level signal CLS from the current detecting part 180, and outputs voltage level data VLD generated by converting the current level signal CLS through an analog digital conversion, to the voltage managing part 260.

In this case, the voltage managing part 260 controls the first off voltage Voff1 according to the voltage level data VLD. In this case, the voltage managing part 260 may control the first off voltage Voff1 by controlling the second off voltage Voff2. For example, the first off voltage Voff1 may be greater than the second off voltage Voff2, and a difference between the first voltage Voff1 and the second voltage Voff2 may be about 4 volts. The voltage managing part 260 may include a look-up table 261 storing the first off voltage Voff1 according to the voltage level data VLD.

Referring to FIGS. 4 and 6, when the relationship of the first off voltage Voff1 and the current signal Ids is changed from the first graph 1 to the second graph 2, the voltage managing part 260 may change the first off voltage Voff1 from the first gate off voltage Vgoff1 to the second gate off voltage Voff2, according to the voltage level data VLD output based on the leakage current of the gate driving part 130.

Referring to FIG. 6 again, since the gate driving part 130, the data driving part 140, the timing controlling part 250, the voltage managing part 260, the leakage current measuring part 170, the current detecting part 180 and the analog digital converting part 290 are used for driving the display panel 110, the gate driving part 130, the data driving part 140, the timing controlling part 250, the voltage managing part 260, the leakage current measuring part 170, the current detecting part 180 and the analog digital converting part 290 may be defined as a display panel driving apparatus.

In addition, since the voltage managing part 260, the leakage current measuring part 170, the current detecting part 180 and the analog digital converting part 290 are used for controlling the first off voltage Voff1 and the second off voltage Voff2, the voltage managing part 260, the leakage current measuring part 170, the current detecting part 180 and the analog digital converting part 290 may be defined as an off voltage controlling part. The off voltage controlling part may be referred to as an off voltage controller.

Figure 7:
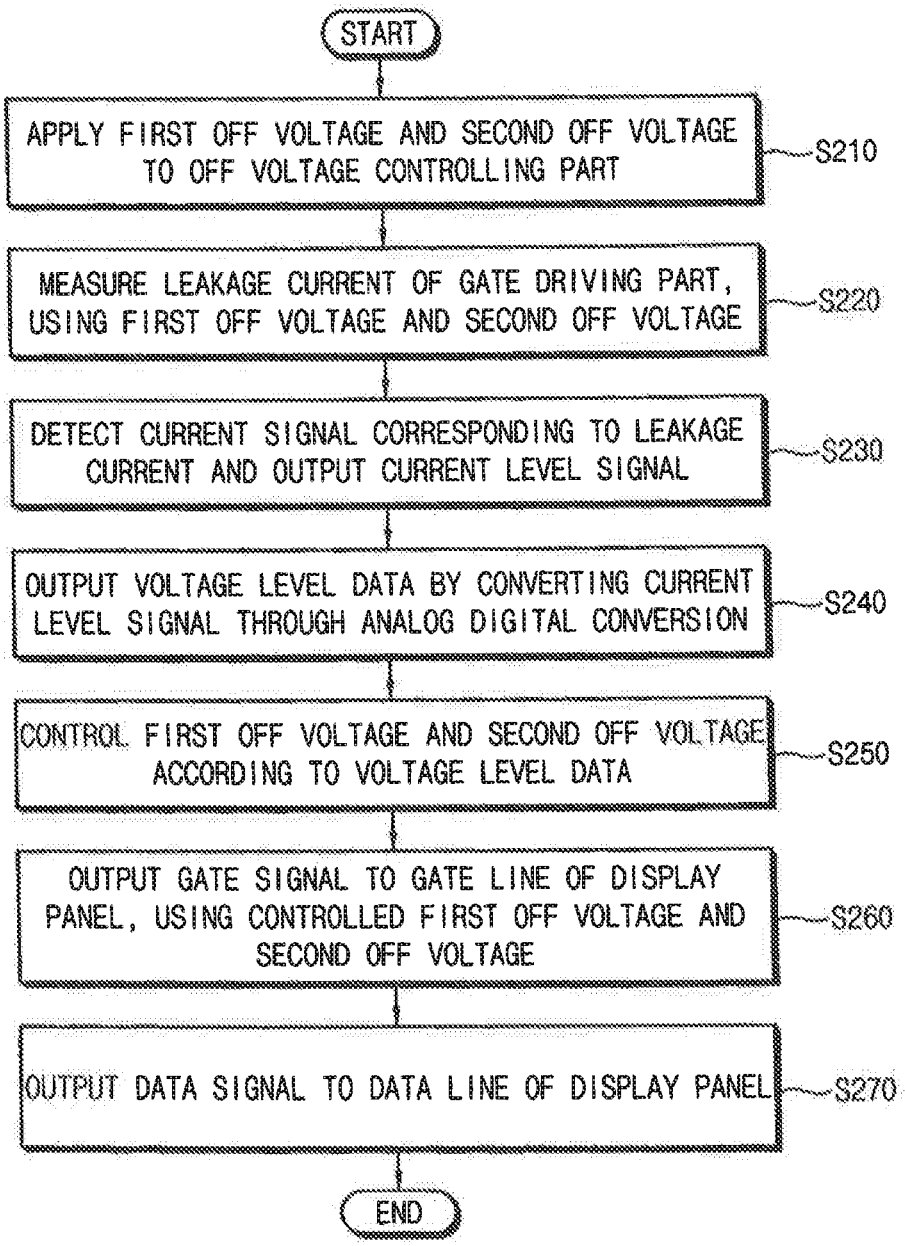
FIG. 7 is a flow chart illustrating a method of driving a display panel performed by a display panel driving apparatus of FIG. 6.

FIG. 7 is a flow chart illustrating a method of driving a display panel performed by the display panel driving apparatus of FIG. 6.

Referring to FIGS. 6 and 7, the first off voltage Voff1 and the second off voltage Voff2 are applied to the off voltage controlling part (step S210). The voltage managing part 260 applies the first off voltage Voff1 and the second off voltage Voff2 applied to the gate driving part 130 to generate the gate signal GS, to the leakage current measuring part 170.

The leakage current of the gate driving part 130 is measured using the first off voltage Voff1 and the second off voltage Voff2 (step S220). The leakage current measuring part 170 receives the first off voltage Voff1 and the second off voltage Voff2 from the voltage managing part 260, measures the leakage current of the gate driving part 130 when the first off voltage Voff1 and the second off voltage Voff2 are applied to the gate driving part 130, and outputs the current signal Ids.

The current signal Ids corresponding to the leakage current is detected and the current level signal CLS is output (step S230). The current detecting part 180 receives the current signal Ids from the leakage current measuring part 170, and detects the current signal Ids to output the current level signal CLS indicating the level of the current signal Ids.

The current level signal CLS is converted through an analog digital conversion and the voltage level data VLD is output (step S240). The analog digital converting part 290 receives the current level signal CLS from the current detecting part 180, and outputs the voltage level data VLD by converting the current level signal CLS through the analog digital conversion, to the voltage managing part 260.

The first off voltage Voff1 and the second off voltage Voff2 are controlled according to the voltage level data VLD (step S250). The voltage managing part 260 controls the first off voltage Voff1 according to the voltage level data VLD. In this case, the voltage managing part 260 may control the first off voltage Voff1 by controlling the second off voltage Voff2. The voltage managing part 260 may include the look-up table 261 storing the first off voltage Voff1 according to the voltage level data VLD.

The gate signal GS is output to the gate line GL of the display panel 110, using the controlled first off voltage Voff1 and the controlled second off voltage Voff2 (step S260). The gate driving part 130 generates the gate signal GS, using the first off voltage Voff1 applied from the voltage managing part 260, the third clock signal CLK3 output from the voltage managing part 260 and including the second off voltage Voff2 and the on voltage Von, and the vertical start voltage STVP output from the voltage managing part 260, and outputs the gate signal OS to the gate line GL of the display panel 110.

The data signal DS is output to the data line DL of the display panel 110 (step S270). The data driving part 140 outputs the data signals DS to the data line DL in response to the horizontal start signal STH and the first clock signal CLK1 provided from the timing controlling part 250.

According to the present exemplary embodiment, the off voltage controlling part including the timing controlling part 250, the voltage managing part 260, the leakage current measuring part 170, the current detecting part 180 and the analog digital converting part 290 controls the first off voltage Voff1 and the second off voltage Voff2 applied to the gate driving part 130, based on the leakage current of the gate driving part 130, and thus an increase of the leakage current of the gate driving part 130 may be prevented. Therefore, an operation error of the gate driving part 130 may be prevented, and thus display quality of the display apparatus 200 including the gate driving part 130 may be improved.

Figure 8:
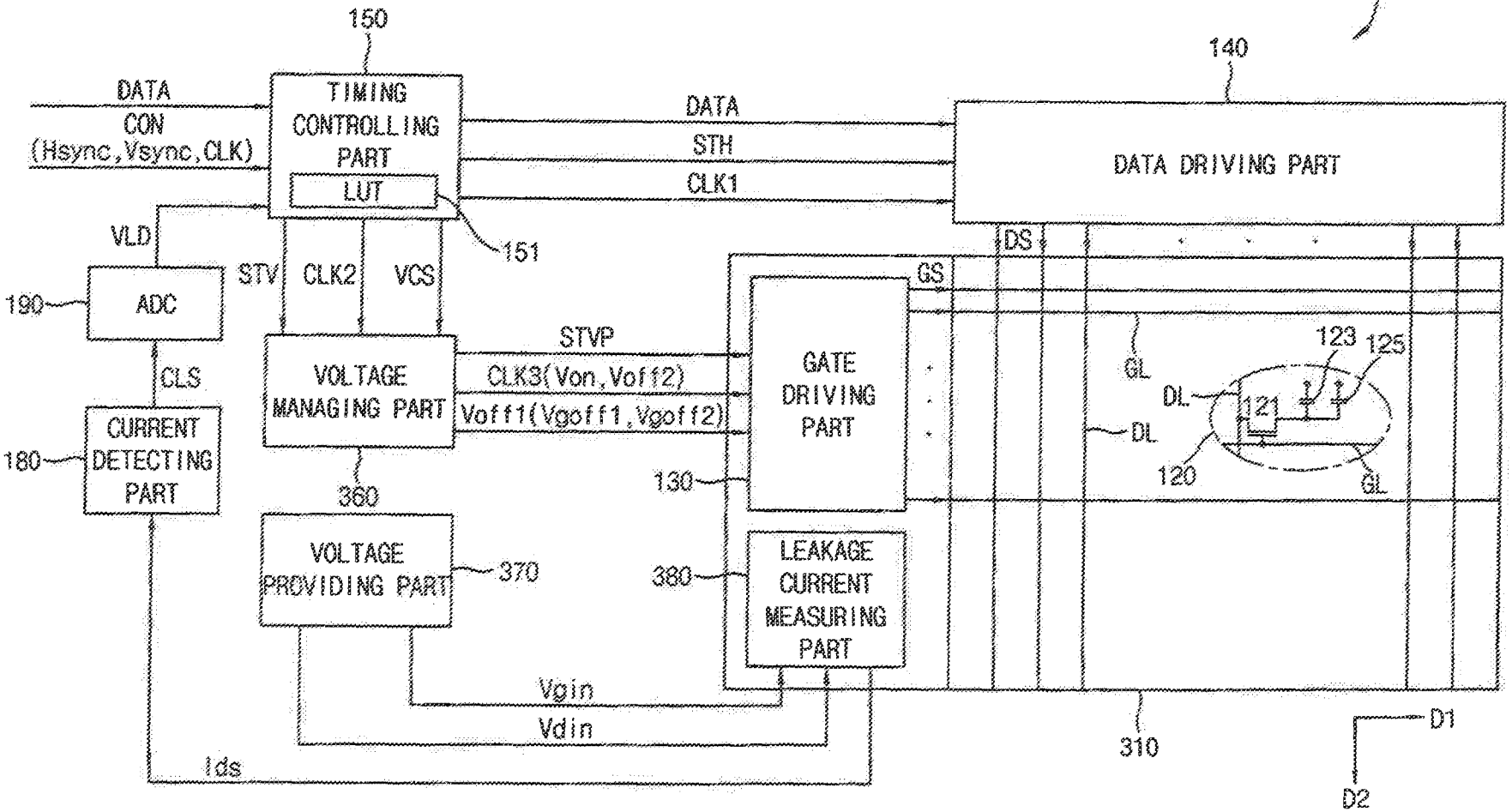
FIG. 8 is a block diagram illustrating a display apparatus according to an exemplary embodiment of the present inventive concept.

FIG. 8 is a block diagram illustrating a display apparatus according to an exemplary embodiment of the present inventive concept.

The display apparatus 300 according to the present exemplary embodiment is substantially the same as the display apparatus 100 according to the previous exemplary embodiment illustrated in FIG. 1 except for a display panel 310, a voltage managing part 360, a voltage providing part 370 and a leakage current measuring part 380. Thus, the same reference numerals will be used to refer to same or like parts as those described in the previous exemplary embodiment and any further repetitive explanation concerning the above elements will be omitted.

Referring to FIG. 8, the display apparatus 300 according to the present exemplary embodiment includes the display panel 310, the gate driving part 130, the data driving part 140, the timing controlling part 150, the voltage managing part 360, the voltage providing part 370, the leakage current measuring part 380, the current detecting part 180 and the analog digital converting part 190. The voltage managing part 360 may be referred to as a voltage manager.

The display panel 310 receives the data signal DS based on an image data DATA provided from the timing controlling part 150 to display an image. For example, the image data DATA may be two-dimensional plane image data. Alternatively, the image data DATA may include a left-eye image data and a right-eye image data for displaying a three-dimensional stereoscopic image.

The display panel 310 includes the gate lines GL, the data lines DL and the plurality of pixels 120. The gate lines GL extend in the first direction D1 and are arranged in the second direction D2 substantially perpendicular to the first direction D1. The data lines DL extend in the second direction D2 and are arranged in the first direction D1. Each of the pixels 120 includes the thin film transistor 121 electrically connected to the gate line GL and the data line DL, the liquid crystal capacitor 123 and the storage capacitor 125 connected to the thin film transistor 121. Thus, the display panel 310 may be a liquid crystal display panel.

The voltage managing part 360 amplifies the vertical start signal STV output from the timing controlling part 150 to generate the vertical start voltage STVP, and outputs the vertical start voltage STVP to the gate driving part 130. In addition, the voltage managing part 360 amplifies the second clock signal CLK2 output from the timing controlling part 150 to generate the third clock signal CLK3, and outputs the third clock signal CLK3 to the gate driving part 130. In addition, the voltage managing part 360 applies the first off voltage Voff1 to the gate driving part 130.

The voltage providing part 370 applies a gate input voltage Vgin and a drain input voltage Vdin to the leakage current measuring part 380. The gate input voltage Vgin may correspond to the first off voltage Vgoff1 and the drain input voltage Vdin may correspond to the second off voltage Voff2.

The leakage current measuring part 380 measures the leakage current of the gate driving part 130 when the first off voltage Voff1 and the second off voltage Voff2 are applied to the gate driving part 130. The leakage current measuring part 380 receives the gate input voltage Vgin corresponding to the first off voltage Voff1 and the drain input voltage Vdin corresponding to the second off voltage Voff2 from the voltage providing part 370, and measures the leakage current of the gate driving part 130, using the gate input voltage Vgin and the drain input voltage Vdin. The leakage current measuring part 380 outputs the current signal Ids corresponding to the leakage current by measuring the leakage current. For example, the leakage current measuring part 380 may output the current signal Ids through a common voltage feedback line.

The leakage current measuring part 380 may be mounted on the display panel 310.

Figure 9:
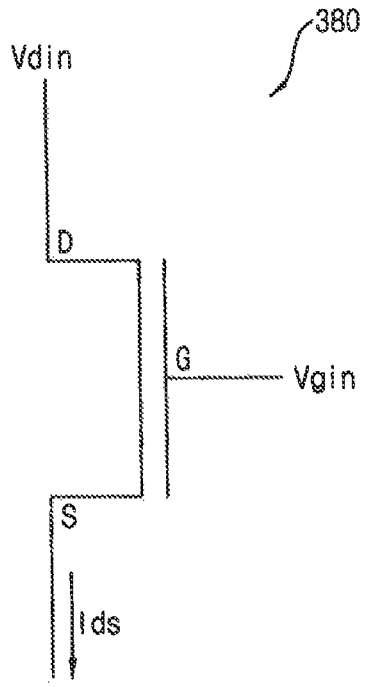
FIG. 9 is a circuit diagram illustrating a leakage current measuring part of FIG. 8.

FIG. 9 is a circuit diagram illustrating the leakage current measuring part 380 of FIG. 8.

Referring to FIGS. 8 and 9, the leakage current measuring part 380 may include a thin film transistor. Here, the thin film transistor may include a gate electrode G to which the gate input voltage Vgin is applied, a drain electrode D to which the drain input voltage Vdin is applied, and a source electrode S through which the current signal Ids is output.

Referring to FIG. 8 again, the voltage managing part 360 receives the voltage control signal VCS from the timing controlling part 150, and controls the first off voltage Voff1 according to the voltage control signal VCS. In this case, the voltage managing part 360 may control the first off voltage Voff1 by controlling the second off voltage Voff2.

Referring to FIGS. 4 and 8, in the case in which the relationship of the first off voltage Voff1 and the current signal Ids is changed from the first graph 1 to the second graph 2, the voltage managing part 360 may change the first off voltage Voff1 from the first gate off voltage Vgoff1 to the second gate off voltage Vgoff2 according to the voltage control signal VCS output based on the leakage current of the gate driving part 130.

Referring to FIG. 8 again, since the gate driving part 130, the data driving part 140, the timing controlling part 150, the voltage managing part 360, the voltage providing part 370, the leakage current measuring part 380, the current detecting part 180 and the analog digital converting part 190 are used for driving the display panel 310, the gate driving part 130, the data driving part 140, the timing controlling part 150, the voltage managing part 360, the voltage providing part 370, the leakage current measuring part 380, the current detecting part 180 and the analog digital converting part 190 may be defined as a display panel driving apparatus.

In addition, since the timing controlling part 150, the voltage managing part 360, the voltage providing part 370, the leakage current measuring part 380, the current detecting part 180 and the analog digital converting part 190 are used for controlling the first off voltage Voff1 and the second off voltage Voff2, the timing controlling part 150, the voltage managing part 360, the voltage providing part 370, the leakage current measuring part 380, the current detecting part 180 and the analog digital converting part 190 may be defined as an off voltage controlling part. The off voltage controlling part may be referred to as an off voltage controller.

Figure 10:
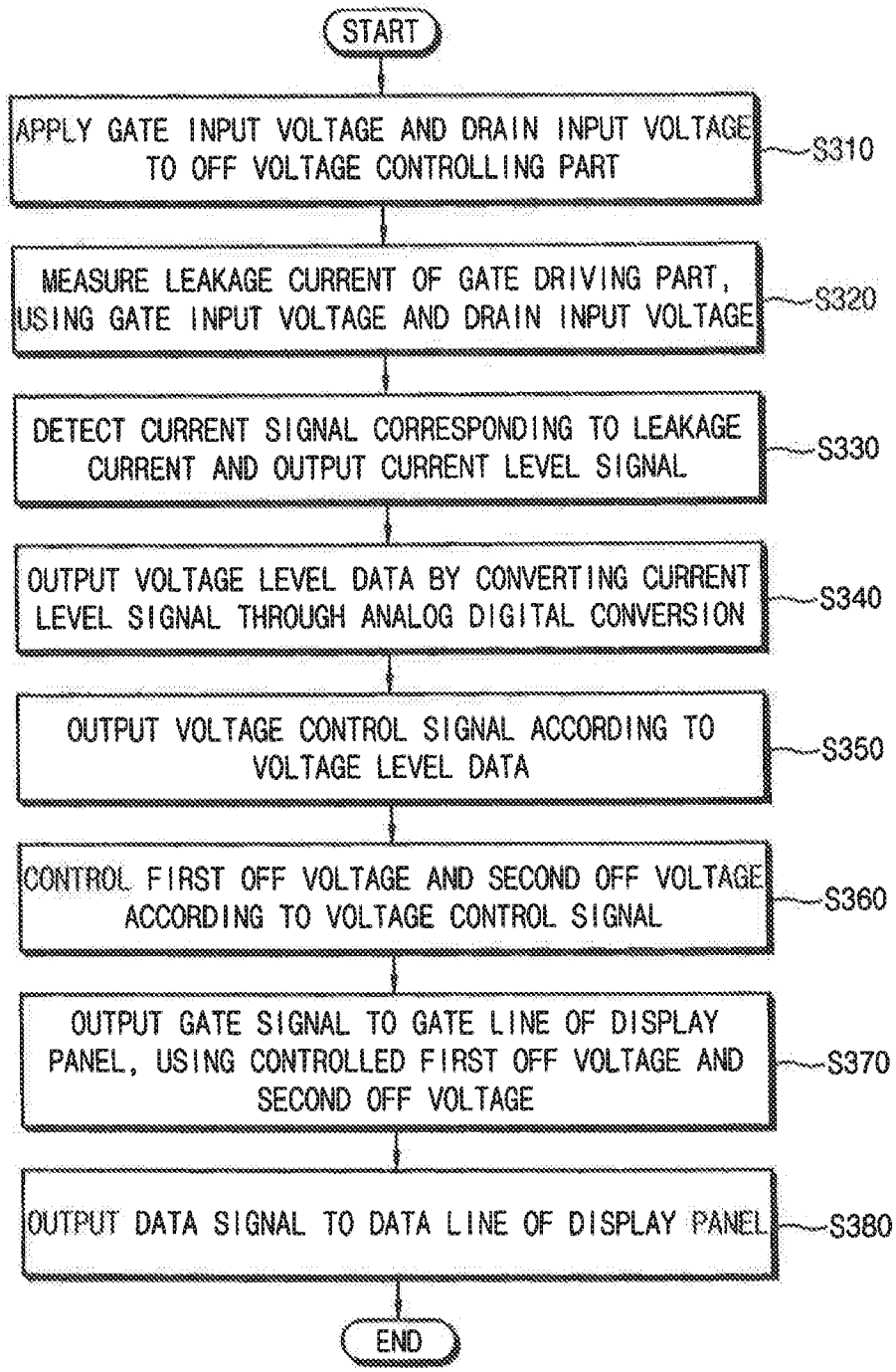
FIG. 10 is a flow chart illustrating a method of driving a display panel performed by a display panel driving apparatus of FIG. 8.

FIG. 10 is a flow chart illustrating a method of driving a display panel performed by the display panel driving apparatus of FIG. 8.

Referring to FIGS. 8 and 10, the gate input voltage Vgin and the drain input voltage Vdin are applied to the off voltage controlling part (step S310). The voltage providing part 370 applies the gate input voltage Vgin corresponding to the first off voltage Voff1 and the drain input voltage Vdin corresponding to the second off voltage Voff2 to the leakage current measuring part 380.

The leakage current of the gate driving part 130 is measured using the gate input voltage Vgin and the data input voltage Vdin (step S320). The leakage current measuring part 380 receives the gate input voltage Vgin and the data input voltage Vdin from the voltage providing part 370, measures the leakage current of the gate driving part 130 when the first off voltage Voff1 and the second off voltage Voff2 are applied to the gate driving part 130, and outputs the current signal Ids.

The current signal Ids corresponding to the leakage current is detected and the current level signal CLS is output (step S330). The current detecting part 180 receives the current signal Ids from the leakage current measuring part 380, and detects the current signal Ids to output the current level signal CLS indicating the level of the current signal Ids.

The current level signal CLS is converted through an analog digital conversion and the voltage level data VLD is output (step S340). The analog digital converting part 190 receives the current level signal CLS from the current detecting part 180, and outputs the voltage level data VLD by converting the current level signal CLS through the analog digital conversion, to the timing controlling part 150.

The voltage control signal VCS is output according to the voltage level data VLD (step S350). The timing controlling part 150 outputs the voltage control signal VCS for controlling the first off voltage Voff1 to the voltage managing part 360, according to the voltage level data VLD. The timing controlling part 150 may include the lookup table 151 storing the first off voltage Voff1 according to the voltage level data VLD.

The first off voltage Voff1 and the second off voltage Voff2 are controlled according to the voltage control signal VCS (step S360). The voltage managing part 360 controls the first off voltage Voff1 according to the voltage control signal VCS. In this case, the voltage managing part 360 may control the first off voltage Voff1 by controlling the second off voltage Voff2.

The gate signal GS is output to the gate line GL of the display panel 110, using the controlled first off voltage Voff1 and the controlled second off voltage Voff2 (step S370). The gate driving part 130 generates the gate signal GS, using the first off voltage Voff1 applied from the voltage managing part 360, the third clock signal CLK3 output from the voltage managing part 360 and including the second off voltage Voff2 and the on voltage Von, and the vertical start voltage STVP output through the voltage managing part 360, and outputs the gate signal GS to the gate line GL of the display panel 310.

The data signal DS is output to the data line DL of the display panel 310 (step S380). The data driving part 140 outputs the data signals DS to the data line DL, in response to the horizontal start signal STH and the first clock signal CLK1 provided from the timing controlling part 150.

According to the present exemplary embodiment, the off voltage controlling part including the timing controlling part 150, the voltage managing part 360, the voltage providing part 370, the leakage current measuring part 380, the current detecting part 180 and the analog digital converting part 190 controls the first off voltage Voff1 and the second off voltage Voff2 applied to the gate driving part 130, based on the leakage current of the gate driving part 130, and thus an increase of the leakage current of the gate driving part 130 may be prevented. Therefore, an operation error of the gate driving part 130 may be prevented, and thus display quality of the display apparatus 300 including the gate driving part 130 may be improved.

Figure 11:
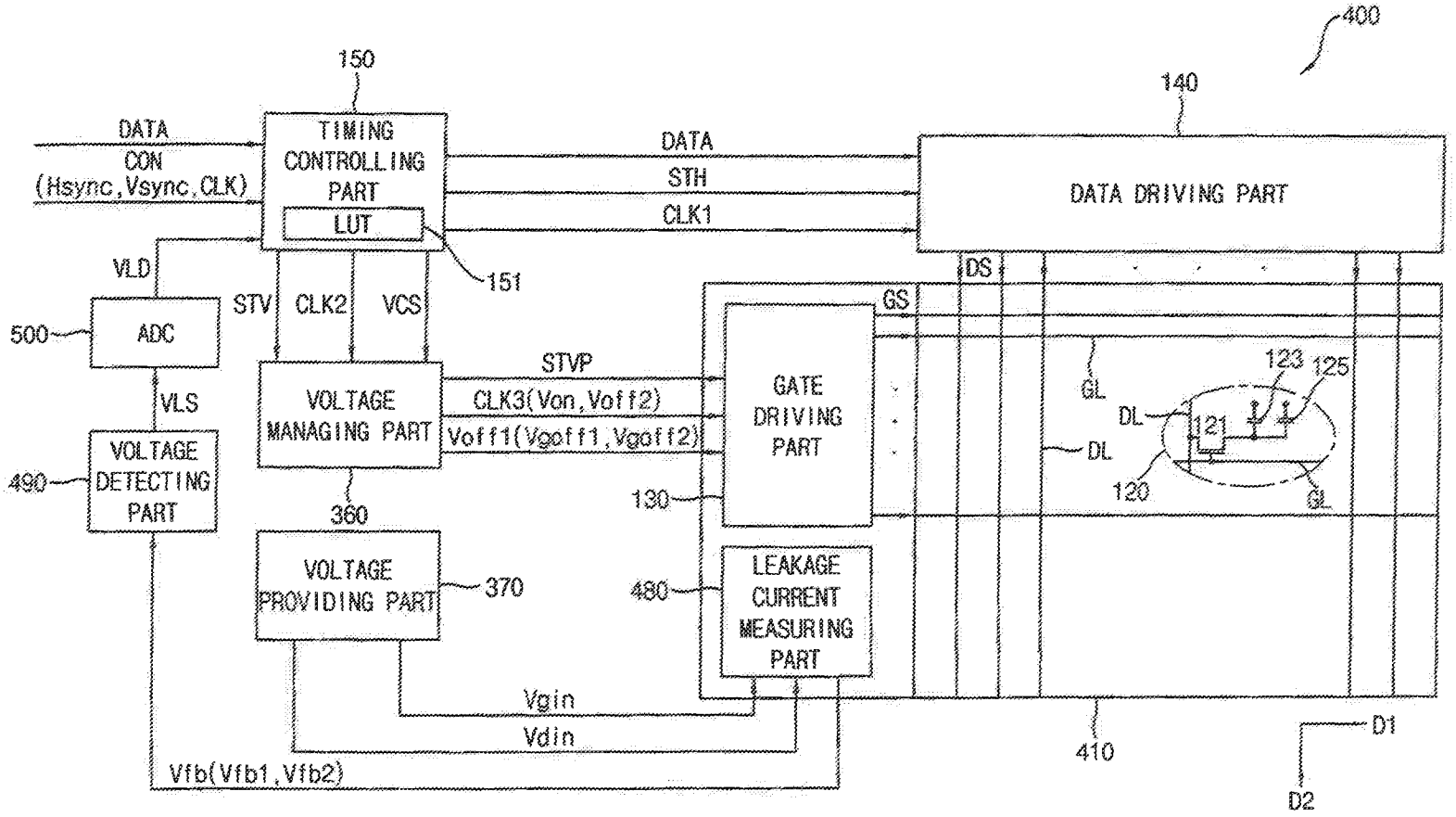
FIG. 11 is a block diagram illustrating a display apparatus according to an exemplary embodiment of the present inventive concept.

FIG. 11 is a block diagram illustrating a display apparatus according to an exemplary embodiment of the present inventive concept.

The display apparatus 400 according to the present exemplary embodiment is substantially the same as the display apparatus 300 according to the previous exemplary embodiment illustrated in FIG. 8 except for a display panel 410, a leakage current measuring part 480, a voltage detecting part 490 and an analog digital converting part 500. Thus, the same reference numerals will be used to refer to same or like parts as those described in the previous exemplary embodiment and any further repetitive explanation concerning the above elements will be omitted.

Referring to FIG. 11, the display apparatus 400 according to the present exemplary embodiment includes the display panel 410, the gate driving part 130, the data driving part 140, the timing controlling part 150, the voltage managing part 360, the voltage providing part 370, the leakage current measuring part 480, the voltage detecting part 490 and the analog digital converting part 500. The voltage managing part 360 may be referred to as a voltage manager.

The display panel 410 receives the data signal DS based on an image data DATA provided from the timing controlling part 150 to display an image. For example, the image data DATA may be two-dimensional plane image data. Alternatively, the image data DATA may include a left-eye image data and a right-eye image data for displaying a three-dimensional stereoscopic image.

The display panel 310 includes the gate lines GL, the data lines DL and the plurality of pixels 120. The gate lines GL extend in the first direction D1 and are arranged in the second direction D2 substantially perpendicular to the first direction D1. The data lines DL extend in the second direction D2 and are arranged in the first direction D1. Each of the pixels 120 includes the thin film transistor 121 electrically connected to the gate line GL and the data line DL, the liquid crystal capacitor 123 and the storage capacitor 125 connected to the thin film transistor 121. Thus, the display panel 410 may be a liquid crystal display panel.

The leakage current measuring part 480 measures the leakage current of the gate driving part 130 when the first off voltage Voff1 and the second off voltage Voff2 are applied to the gate driving part 130. The leakage current measuring part 480 receives the gate input voltage Vgin corresponding to the first off voltage Voff1 and the drain input voltage Vdin corresponding to the second off voltage Voff2 from the voltage providing part 370, and measures the leakage current of the gate driving part 130, using the gate input voltage Vgin and the drain input voltage Vdin. The leakage current measuring part 480 outputs a feedback voltage signal Vfb according to the leakage current by measuring the leakage current. For example, the leakage current measuring part 480 may output the feedback voltage signal Vfb through a common voltage feedback line.

The leakage current measuring part 480 may be mounted on the display panel 410.

Figure 12:
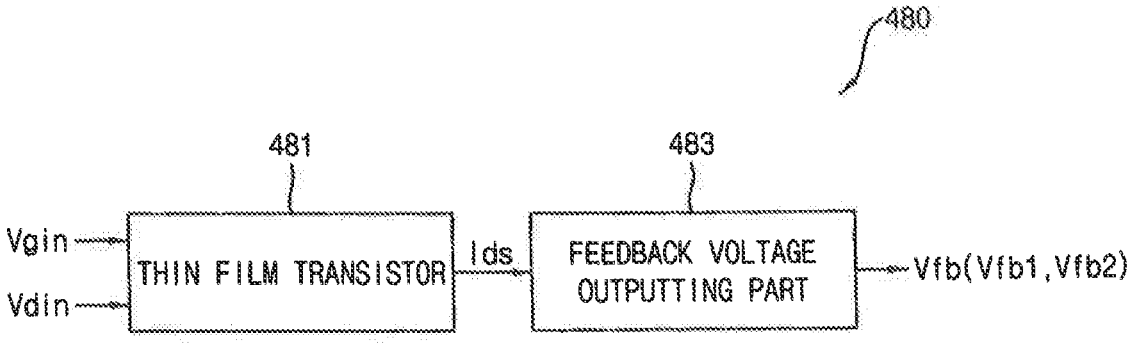
FIG. 12 is a block diagram illustrating a leakage current measuring part of FIG. 11.

FIG. 12 is a block diagram illustrating the leakage current measuring part 480 of FIG. 11.

Referring to FIGS. 11 and 12, the leakage current measuring part 480 includes a thin film transistor 481 and a feedback voltage outputting part 483.

The thin film transistor 481 is substantially the same as the thin film transistor in the leakage current measuring part 380 according to the previous exemplary embodiment illustrated in FIG. 9. Thus, the thin film transistor 481 may include a gate electrode to which the gate input voltage Vgin is applied, a drain electrode to which the drain input voltage Vdin is applied, and a source electrode through which the current signal Ids is output.

The feedback voltage outputting part 483 receives the current signal Ids from the thin film transistor 481, and outputs the feedback voltage signal Vfb according to the current signal Ids, using an RC delay. The feedback voltage outputting part 483 may output a first feedback voltage signal Vfb1 and a second feedback voltage signal Vfb2 according to the current signal Ids.

Figure 13:
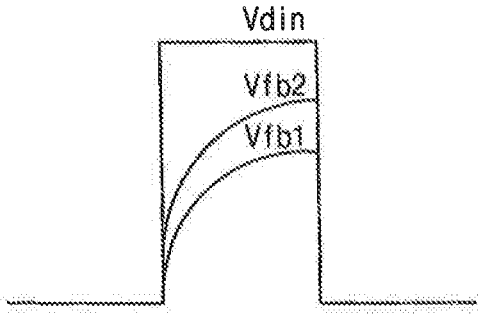
FIG. 13 is a waveforms diagram illustrating a drain input voltage, a first feedback voltage signal and a second feedback voltage signal of FIG. 11.

FIG. 13 is a waveforms diagram illustrating the drain input voltage Vdin, the first feedback voltage signal Vfb1 and the second feedback voltage signal Vfb2 of FIG. 11.

Referring to FIGS. 4 and 11 to 13, in the case in which the relationship of the first off voltage Voff1 and the current signal Ids is shown as the first graph 1, when the first off voltage Voff1 is the first gate off voltage Vgoff1, the current of the current signal Ids is about 0.001 pico ampere (pA) as shown at the point A. In this case, the leakage current measuring part 480 may output the first feedback voltage signal Vfb1.

However, in the case in which the relationship of the first off voltage Voff1 and the current signal Ids is changed to the second graph 2, when the first off voltage Voff1 is the first gate off voltage Vgoff1, the current of the current signal Ids is about 1000 pA as shown at the point B. Thus, the leakage current of the gate driving part 130, which indicated by the current signal Ids increases. In this case, the leakage current measuring part 480 may output the second feedback voltage signal Vfb2 greater than the first feedback voltage Vfb1.

Referring to FIG. 11 again, the voltage detecting part 490 receives the feedback voltage signal Vfb from the leakage current measuring part 480, and detects the feedback voltage signal Vfb to output a voltage level signal VLS indicating a level of the feedback voltage signal Vfb.

The analog digital converting part 500 receives the voltage level signal VLS from the voltage detecting part 490, and outputs voltage level data VLD generated by converting the voltage level signal VLS through an analog digital conversion, to the timing controlling part 150.

In this case, the timing controlling part 150 outputs the voltage control signal VCS for controlling the first off voltage Voff1 to the voltage managing part 360, according to the voltage level data VLD. The timing controlling part 150 may include the look-up table 151 storing the first off voltage Voff1 according to the voltage level data VLD.

The voltage managing part 360 receiving the voltage control signal VCS from the timing controlling part 150 controls the first off voltage Voff1 according to the voltage control signal VCS. In this case, the voltage managing part 360 may control the first off voltage Voff1 by controlling the second off voltage Voff2.

Since the gate driving part 130, the data driving part 140, the timing controlling part 150, the voltage managing part 360, the voltage providing part 370, the leakage current measuring part 480, the voltage detecting part 490 and the analog digital converting part 500 are used for driving the display panel 410, the gate driving part 130, the data driving part 140, the timing controlling part 150, the voltage managing part 360, the voltage providing part 370, the leakage current measuring part 480, the voltage detecting part 490 and the analog digital converting part 500 may be defined as a display panel driving apparatus.

In addition, since the timing controlling part 150, the voltage managing part 360, the voltage providing part 370, the leakage current measuring part 480, the voltage detecting part 490 and the analog digital converting part 500 are used for controlling the first off voltage Voff1 and the second off voltage Voff2, the timing controlling part 150, the voltage managing part 360, the voltage providing part 370, the leakage current measuring part 480, the voltage detecting part 490 and the analog digital converting part 500 may be defined as an off voltage controlling part. The off voltage controlling part may be referred to as an off voltage controller.

Figure 14:
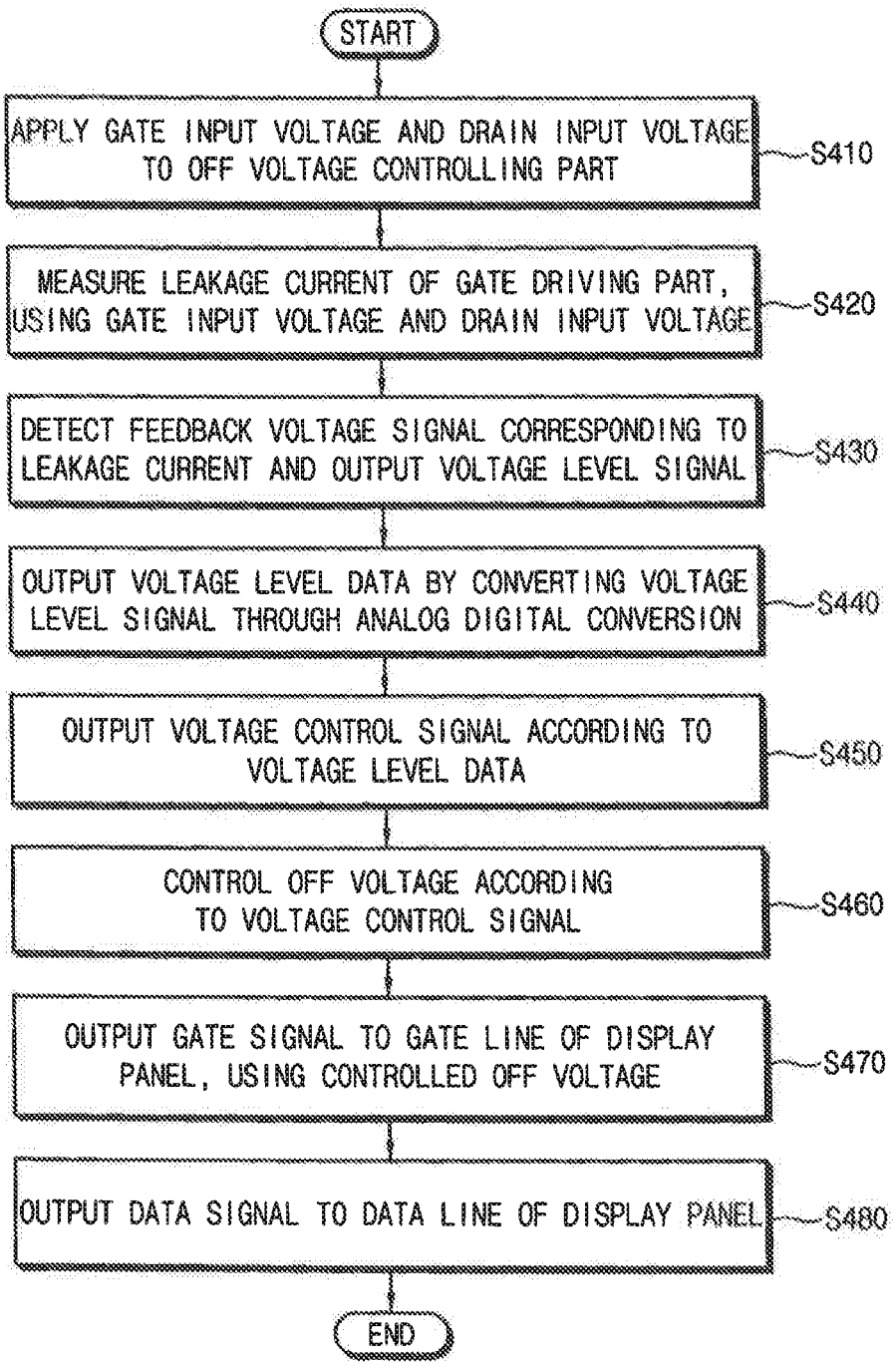
FIG. 14 is a flow chart illustrating a method of driving a display panel performed by a display panel driving apparatus of FIG. 11.

FIG. 14 is a flow chart illustrating a method of driving a display panel performed by the display panel driving apparatus of FIG. 11.

Referring to FIGS. 11 and 14, the gate input voltage Vgin and the drain input voltage Vdin are applied to the off voltage controlling part (step S410). The voltage providing part 370 applies the gate input voltage Vgin corresponding to the first off voltage Voff1 and the drain input voltage Vdin corresponding to the second off voltage Voff2 to the leakage current measuring part 480.

The leakage current of the gate driving part 130 is measured using the gate input voltage Vgin and the data input voltage Vdin (step S420). The leakage current measuring part 480 receives the gate input voltage Vgin and the data input voltage Vdin from the voltage providing part 370, measures the leakage current of the gate driving part 130 when the first off voltage Voff1 and the second off voltage Voff2 are applied to the gate driving part 130, and outputs the feedback voltage signal Vfb.

The feedback voltage signal Vfb corresponding to the leakage current is detected and the voltage level signal VLS is output (step S430). The voltage detecting part 490 receives the feedback voltage signal Vfb from the leakage current measuring part 480, and detects the feedback voltage signal Vfb to output the voltage level signal VLS indicating the level of the feedback voltage signal Vfb.

The voltage level signal VLS is converted through an analog digital conversion and the voltage level data VLD is output (step S440). The analog digital converting part 500 receives the voltage level signal VLS from the voltage detecting part 490, and outputs the voltage level data VLD by converting the voltage level signal VLS through the analog digital conversion, to the timing controlling part 150.

The voltage control signal VCS is output according to the voltage level data VLD (step S450). The timing controlling part 150 outputs the voltage control signal VCS for controlling the first off voltage Voff1 to the voltage managing part 360, according to the voltage level data VLD. The timing controlling part 150 may include the look-up table 151 storing the first off voltage Voff1 according to the voltage level data VLD.

The first off voltage Voff1 and the second off voltage Voff2 are controlled according to the voltage control signal VCS (step S460). The voltage managing part 360 controls the first off voltage Voff1 according to the voltage control signal VCS. In this case, the voltage managing part 360 may control the first off voltage Voff1 by controlling the second off voltage Voff2.

The gate signal GS is output to the gate line GL of the display panel 110, using the controlled first off voltage Voff1 and the controlled second off voltage Voff2 (step S470). The gate driving part 130 generates the gate signal GS, using the first off voltage Voff1 applied from the voltage managing part 360, the third clock signal CLK3 output from the voltage managing part 360 and including the second off voltage Voff2 and the on voltage Von, and the vertical start voltage STVP output from the voltage managing part 360, and outputs the gate signal GS to the gate line GL of the display panel 410.

The data signal DS is output to the data line DL of the display panel 310 (step S480). The data driving part 140 outputs the data signals DS to the data line DL in response to the horizontal start signal STH and the first clock signal CLK1 provided from the timing controlling part 150.

According to the present exemplary embodiment, the off voltage controlling part including the timing controlling part 150, the voltage managing part 360, the voltage providing part 370, the leakage current measuring part 480, the voltage detecting part 490 and the analog digital converting part 500 controls the first off voltage Voff1 and the second off voltage Voff2 applied to the gate driving part 130, based on the leakage current of the gate driving part 130, and thus an increase of the leakage current of the gate driving part 130 may be prevented. Therefore, an operation error of the gate driving part 130 may be prevented, and thus display quality of the display apparatus 400 including the gate driving part 130 may be improved.

Figure 15:
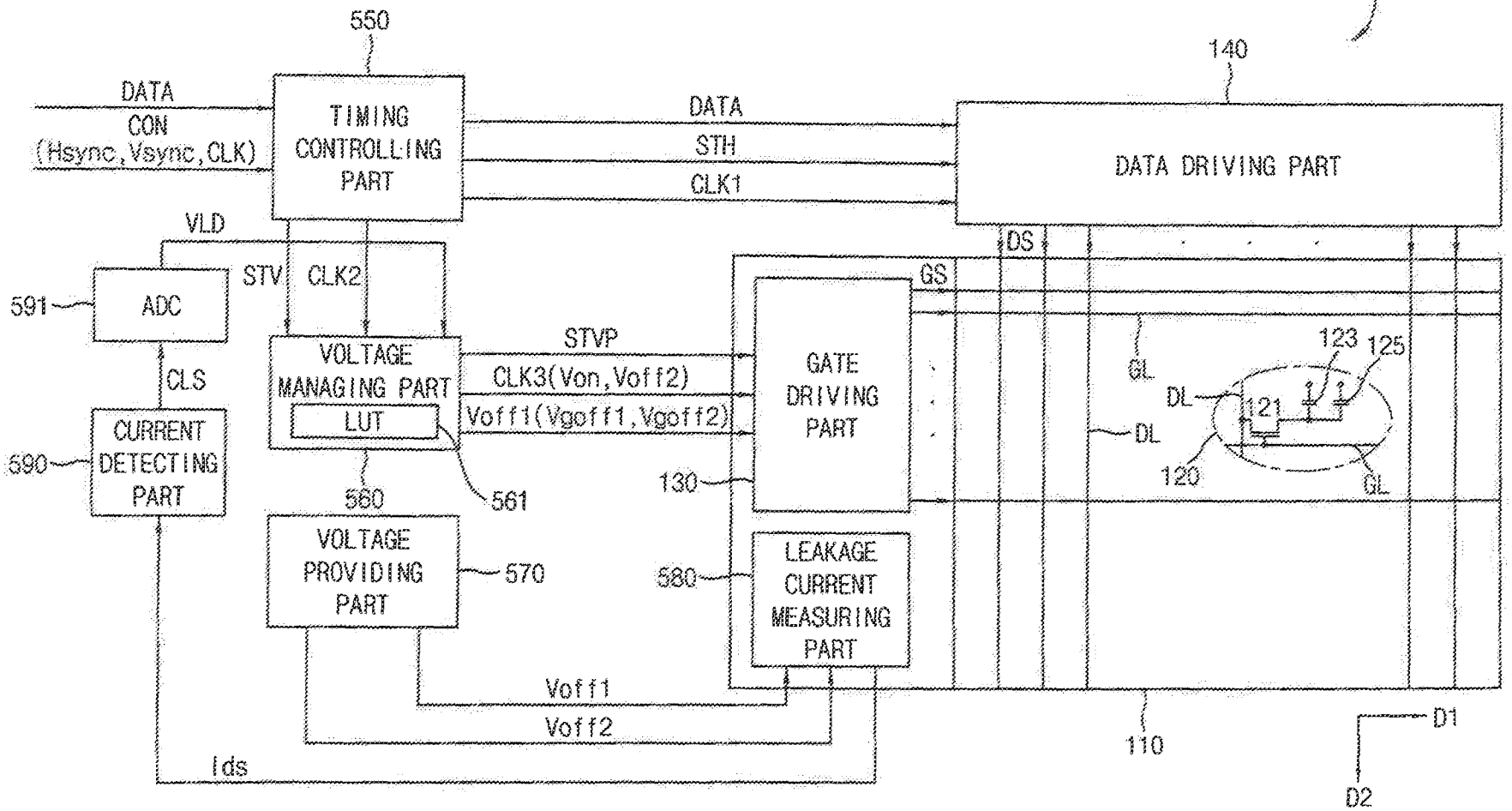
FIG. 15 is a block diagram illustrating a display apparatus according to an exemplary embodiment of the present inventive concept.

FIG. 15 is a block diagram illustrating a display apparatus according to an exemplary embodiment of the present inventive concept.

The display apparatus 500 according to the present exemplary embodiment is substantially the same as the display apparatus 100 according to the previous exemplary embodiment illustrated in FIG. 1 except for a timing controlling part 550, a voltage managing part 560, the voltage providing part 570 and an analog digital converting part 591. Thus, the same reference numerals will be used to refer to same or like parts as those described in the previous exemplary embodiment and any further repetitive explanation concerning the above elements will be omitted.

Referring to FIG. 15, the display apparatus 500 according to the present exemplary embodiment includes the display panel 110, the gate driving part 130, the data driving part 140, the timing controlling part 550, the voltage managing part 560, the voltage providing part 570, the leakage current measuring part 580, the current detecting part 590 and the analog digital converting part 591.

The timing controlling part 550 receives the image data DATA and the control signal CON from an outside source. The control signal CON may include the horizontal synchronous signal Hsync, the vertical synchronous signal Vsync and the clock signal CLK. The timing controlling part 550 outputs the image data DATA to the data driving part 140. In addition, the timing controlling part 550 generates the horizontal start signal STH using the horizontal synchronous signal Hsync and outputs the horizontal start signal STH to the data driving part 140. In addition, the timing controlling part 550 generates the vertical start signal STV using the vertical synchronous signal Vsync and outputs the vertical start signal STV to the voltage managing part 560. In addition, the timing controlling part 550 generates the first clock signal CLK1 and the second clock signal CLK2 using the clock signal CLK, outputs the first clock signal CLK1 to the data driving part 140, and outputs the second clock signal CLK2 to the voltage managing part 560.

The voltage managing part 560 amplifies the vertical start signal STV output from the timing controlling part 550 to generate the vertical start voltage STVP, and outputs the vertical start voltage STVP to the gate driving part 130. In addition, the voltage managing part 560 amplifies the second clock signal CLK2 output from the timing controlling part 550 to generate the third clock signal CLK3, and outputs the third clock signal CLK3 to the gate driving part 130. Additionally, the voltage managing part 560 applies the first off voltage Voff1 to the gate driving part 130.

The analog digital converting part 591 receives the current level signal CLS from the current detecting part 590, and outputs voltage level data VLD generated by converting the current level signal CLS through an analog digital conversion, to the voltage managing part 560.

In this case, the voltage managing part 560 controls the first off voltage Voff1 according to the voltage level data VLD. In this case, the voltage managing part 560 may control the first off voltage Voff1 by controlling the second off voltage Voff2. For example, the first off voltage Voff1 may be greater than the second off voltage Voff2, and a difference between the first voltage Voff1 and the second voltage Voff2 may be about 4 volts. The voltage managing part 560 may include a look-up table 561 storing the first off voltage Voff1 according to the voltage level data VLD.

The voltage providing part 570 applies a gate input voltage Vgin and a drain input voltage Vdin to the leakage current measuring part 580. The gate input voltage Vgin may correspond to the first off voltage Vgoff1 and the drain input voltage Vdin may correspond to the second off voltage Voff2.

The leakage current measuring part 580 measures the leakage current of the gate driving part 130 when the first off voltage Voff1 and the second off voltage Voff2 are applied to the gate driving part 130. The leakage current measuring part 580 receives the gate input voltage Vgin corresponding to the first off voltage Voff1 and the drain input voltage Vdin corresponding to the second off voltage Voff2 from the voltage providing part 570, and measures the leakage current of the gate driving part 130, using the gate input voltage Vgin and the drain input voltage Vdin. The leakage current measuring part 580 outputs the current signal Ids corresponding to the leakage current by measuring the leakage current. For example, the leakage current measuring part 580 may output the current signal Ids through a common voltage feedback line.

Referring to FIG. 15, the leakage current measuring part 580 may include a thin film transistor. Here, the thin film transistor may include a gate electrode G to which the gate input voltage Vgin is applied, a drain electrode D to which the drain input voltage Vdin is applied, and a source electrode S through Which the current signal Ids is output.

Referring to FIG. 15 again, the voltage managing part 560 receives the voltage level data VLD from the analog digital conversion 591, and controls the first off voltage Voff1 according to the voltage control signal VCS. In this case, the voltage managing part 560 may control the first off voltage Voff1 by controlling the second off voltage Voff2.

Referring to FIGS. 4 and 15, when the relationship of the first off voltage Voff1 and the current signal Ids is changed from the first graph 1 to the second graph 2, the voltage managing part 560 may change the first off voltage Voff1 from the first gate off voltage Vgoff1 to the second gate off voltage Voff2, according to the voltage level data VLD output based on the leakage current of the gate driving part 130.

Referring to FIG. 15 again, since the gate driving part 130, the data driving part 140, the timing controlling part 550, the voltage managing part 560, the voltage providing part 570, the leakage current measuring part 580, the current detecting part 590 and the analog digital converting part 591 are used for driving the display panel 110, the gate driving part 130, the data driving part 140, the timing controlling part 550, the voltage managing part 560, the voltage providing part 570, the leakage current measuring part 580, the current detecting part 590 and the analog digital converting part 591 may be defined as a display panel driving apparatus.

In addition, since the voltage managing part 560, the voltage providing part 570, the leakage current measuring part 580, the current detecting part 590 and the analog digital converting part 591 are used for controlling the first off voltage Voff1 and the second off voltage Voff2, the voltage managing part 560, the voltage providing part 570, the leakage current measuring part 580, the current detecting part 590 and the analog digital converting part 591 may be defined as an off voltage controlling part. The off voltage controlling part may be referred to as an off voltage controller.

Referring to FIG. 15, the gate input voltage Vgin and the drain input voltage Vdin are applied to the off voltage controlling part. The voltage providing part 570 applies the gate input voltage Vgin corresponding to the first off voltage Voff1 and the drain input voltage Vdin corresponding to the second off voltage Voff2 to the leakage current measuring part 580.

The leakage current of the gate driving part 130 is measured using the gate input voltage Vgin and the data input voltage Vdin. The leakage current measuring part 580 receives the gate input voltage Vgin and the data input voltage Vdin from the voltage providing part 570, measures the leakage current of the gate driving part 130 when the first off voltage Voff1 and the second off voltage Voff2 are applied to the gate driving part 130, and outputs the current signal Ids.

The current signal Ids corresponding to the leakage current is detected and the current level signal CLS is output. The current detecting part 590 receives the current signal Ids from the leakage current measuring part 580, and detects the current signal Ids to output the current level signal CLS indicating the level of the current signal Ids.

The current level signal CLS is converted through an analog digital conversion and the voltage level data VLD is output. The analog digital converting part 591 receives the current level signal CLS from the current detecting part 590, and outputs the voltage level data VLD by converting the current level signal CLS through the analog digital conversion, to the voltage managing part 560.

The first off voltage Voff1 and the second off voltage Voff2 are controlled according to the voltage level data VLD. The voltage managing part 560 controls the first off voltage Voff1 according to the voltage level data VLD. In this case, the voltage managing part 560 may control the first off voltage Voff1 by controlling the second off voltage Voff2. The voltage managing part 560 may include the look-up table 561 storing the first off voltage Voff1 according to the voltage level data VLD.

The gate signal GS is output to the gate line GL of the display panel 110, using the controlled first off voltage Voff1 and the controlled second off voltage Voff2. The gate driving part 130 generates the gate signal GS, using the first off voltage Voff1 applied from the voltage managing part 560, the third clock signal CLK3 output from the voltage managing part 560 and including the second off voltage Voff2 and the on voltage Von, and the vertical start voltage STVP output from the voltage managing part 560, and outputs the gate signal GS to the gate line CL of the display panel 110.

The data signal DS is output to the data line DL of the display panel 110. The data driving part 140 outputs the data signals DS to the data line DL in response to the horizontal start signal STH and the first clock signal CLK1 provided from the timing controlling part 550.

According to the present exemplary embodiment, the off voltage controlling part including the timing controlling part 550, the voltage managing part 560, the leakage current measuring part 580, the current detecting part 590 and the analog digital converting part 591 controls the first off voltage Voff1 and the second off voltage Voff2 applied to the gate driving part 130, based on the leakage current of the gate driving part 130, and thus an increase of the leakage current of the gate driving part 130 may be prevented. Therefore, an operation error of the gate driving part 130 may be prevented, and thus display quality of the display apparatus 500 including the gate driving part 130 may be improved.

According to an exemplary embodiment, a display panel driving apparatus, a method of driving a display panel using the display panel driving apparatus, and a display apparatus having the display panel driving apparatus, have an off voltage applied to a gate driving part controlled based on a leakage current of the gate driving part. Accordingly, an increase of the leakage current of the gate driving part may be prevented. Therefore, an operation error of the gate driving part may be prevented, and thus display quality of a display apparatus including the gate driving part may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed:

1. A display panel driving apparatus comprising:

a data driving part configured to output a data signal to a data line of a display panel;

a gate driving part configured to output a gate signal to a gate line of the display panel;

an off voltage controller configured to receive a first off voltage and a second off voltage applied to the gate driving part to generate the gate signal, measure a leakage current of the gate driving part, and control the first off voltage based on the leakage current, wherein the second off voltage has a lower level than that of the first off voltage, wherein the off voltage controller comprises a leakage current measuring part configured to measure the leakage current and output a current signal, and wherein the leakage current measuring part includes a transistor having a gate electrode to which the first off voltage is applied, a drain electrode to which the second off voltage is applied, and a source electrode through which the current signal, which corresponds to the leakage current of the gate driving part, is output; and a timing controller configured to apply a clock signal to the gate driving part, wherein the clock signal has an on voltage as a high level and the second off voltage as a low level, and the on voltage has a higher level than the first off voltage.

2. The display panel driving apparatus of claim 1, wherein the off voltage controller further comprises a current detecting part configured to receive the current signal, detect the current signal and output a current level signal indicating a level of the current signal.

3. The display panel driving apparatus of claim 2, wherein the off voltage controller further comprises an analog digital converting part configured to receive the current level signal, and output a voltage level data by converting the current level signal into a digital type.

4. The display panel driving apparatus of claim 3, wherein the off voltage controller further comprises a look-up table storing the first off voltage according to the voltage level data.

5. The display panel driving apparatus of claim 4, wherein the off voltage controller further comprises a voltage manager applying the first off voltage to the gate driving part and outputting the clock signal having the on voltage and the second off voltage, and the voltage manager includes the look-up table, and controls the first off voltage according to the voltage level data output from the analog digital converting part.

6. The display panel driving apparatus of claim 1, wherein the leakage current measuring part outputs a feedback voltage signal according to the leakage current, using an RC delay.

7. The display panel driving apparatus of claim 6, wherein the off voltage controller comprises a voltage detecting part configured to receive the feedback voltage signal, and detect the feedback voltage signal to output a voltage level signal indicating a level of the feedback voltage signal.

8. The display panel driving apparatus of claim 7, wherein the off voltage controller further comprises an analog digital converting part configured to receive the voltage level signal and output a voltage level data by converting the voltage level signal into a digital type.

9. The display panel driving apparatus of claim 1, wherein the off voltage controller further comprises a voltage providing part configured to apply a gate input voltage corresponding to the first off voltage and a drain input voltage corresponding to the second off voltage to a thin film transistor of the leakage current measuring part.

10. A method of driving a display panel, the method comprising:

applying a first off voltage and a second off voltage to a gate driving part to output a gate signal and to an off voltage controlling part, wherein the second of voltage has a lower level than that of the first off voltage;

measuring a leakage current of the gate driving part, using the first off voltage and the second off voltage applied to the off voltage controlling part;

outputting a current signal corresponding to the leakage current of the gate driving part through a source electrode of a transistor included in the off voltage controlling part, wherein the first off voltage is applied to a gate electrode of the transistor, and the second off voltage is applied to a drain electrode of the transistor;

controlling the first off voltage based on the leakage current;

outputting the gate signal to a gate line of a display panel using the controlled first off voltage and a clock signal having an on voltage and the second off voltage;

outputting a data signal to a data line of the display panel;

applying the clock signal to the gate driving part, wherein the clock signal has the on voltage as a high level and the second off voltage as a low level, and the on voltage has a higher level than the first off voltage.

11. The method of claim 10, wherein the controlling the first off voltage, based on the leakage current comprises:

detecting a feedback voltage according to the leakage current and output from the leakage current measuring part to which the first off voltage and the second off voltage are applied, to output a voltage level signal indicating a level of the feedback voltage;

outputting a voltage level data by converting the voltage level signal into a digital type; and controlling the first off voltage according to the voltage level data.

* * * * *